US006161239A

United States Patent [19]

Grazel

[11] Patent Number: 6,161,239

[45] Date of Patent: Dec. 19, 2000

[54] INFANT POSITIONING DEVICE

[76] Inventor: Regina Grazel, 124 Crescent Hollow Dr., Sewell, N.J. 08080

[21] Appl. No.: 09/495,033

[22] Filed: Jan. 31, 2000

[51] Int. Cl.[7] ..... A47D 15/00; A47G 9/00

[52] U.S. Cl. ..... 5/655; 5/655.4; 5/911

[58] Field of Search ..... 5/655, 911, 655.4, 5/630, 702, 632

[56] References Cited

U.S. PATENT DOCUMENTS

| | | | |
|---|---|---|---|
| 4,139,920 | 2/1979 | Evans | 5/655.4 |
| 4,163,297 | 8/1979 | Neumark | 5/911 |
| 4,607,403 | 8/1986 | Alivizatos | 5/655 |
| 4,689,844 | 9/1987 | Azivizatos | 5/655 |
| 5,182,828 | 2/1993 | Alivizatos | 5/655 |
| 5,279,237 | 1/1994 | Alivizatos | 5/655 |
| 5,371,909 | 12/1994 | McCarty | 5/655 |
| 5,996,152 | 12/1999 | Wilson | 5/655 |

FOREIGN PATENT DOCUMENTS

| | | | |
|---|---|---|---|
| 4237792 | 5/1993 | Germany | 5/655 |

*Primary Examiner*—Alexander Grosz
*Attorney, Agent, or Firm*—Roger M. Rathbun

[57] ABSTRACT

An infant positioning device that is an elongated sleeve filled with polymeric pellets to a predetermined fill density to enable the device to be adaptable to conform to the contour of an infant to aid holding the infant in a optimum position for the wellbeing of the infant. The sleeve is preferably of a polyester material and the pellets are preferably small pellets composed of a high density polyethylene material. By controlling the fill density of the pellets, the device can be sufficiently pliable so as to be wrapped about the infant for positioning the infant and yet exhibit the stability and weight to hold the infant in the desired position. Due to the selection of the materials used for the sleeve and the pellets, the overall positioning device is washable without disassembly.

6 Claims, 1 Drawing Sheet

INFANT POSITIONING DEVICE

BACKGROUND

This invention relates to a device to enable the positioning of an infant, and, more particularly, to a device that can preferably be used with an infant being supported within various infant apparatus or equipment such as an infant incubator, infant warmer, bassinet or pediatric crib and the like and which device can be used to maintain the infant in a desired position. The infant positioning device, in differing sizes, can be use with preterm infants as well as full term infants.

In general, new born infants, particularity premature infants require assistance to their wellbeing and such assistance may be provided by various apparatus such an infant incubator or infant warmer. Due to the lack of development of the infant, there is a decreased muscle tone and the infant, if left totally unattended, would tend to lay in an extended position. That position is not conducive to growth of the infant and it is more advantageous to maintain the infant in a simulated fetal position to enhance the growth.

Thus, it is important to the further growth and wellbeing of the infant to provide a support for the infant that can easily maintain the infant in the desired position. Since it is known that the preferred position is a confined position where the infant is stabilized and supported in an optimum resting position that simulates the fetal position, the particular support, therefore, needs to be adaptable to provide that support to the infant. The use of such support or confinement also encourages comforting the infant and preferably enables the infant to be placed in any of a variety of positions desired by the caregiver.

At the present, there are a variety of devices that are used for the aforedescribed purpose, some of which are makeshift arrangements, such as the use of rolls of blankets, sheets or cloth diapers that are rolled up to surround or otherwise support the infant in an attempt to simulate the confines of the womb or to place the infant in some other desired position. Such makeshift devices, however, have a tendency to loosen, unroll, or just shift away from the desired position against the infant and eventually defeat the intended purpose. In addition, of course, the preferred device would be a one-piece device that is conformed to the contour of the individual infant.

There are currently commercial products that do assist in such positioning of an infant, one of which is shown and described in U.S. Pat. No. 5,371,909 of McCarty. In that patent, the infant positioning device utilizes a lead bar that is positioned interior of the device and which enables the elongated device to be bent to the desired position and retained in that position. A difficult arises, however, in that the lead bar, if bent too often, can break and the device is no longer usable for the intended purpose. In addition, the McCarty device has to be disassembled for cleaning, the lead bar removed, and then reassembled after the cleaning. It would be preferable for the device to be completely washable without such disassembly for the convenience of the nursing staff.

Further, in U.S. Pat. No. 5,581,832 of Bridley, there is another support for an infant however it utilizes a plurality of components adjustably positioned with respect to each other to contain the infant therebetween. Thus, the device requires more than one component and also needs a special pad on which the infant is positioned having hook and loop (Velcro) fastener strips affixed to that special pad. Thus, the Bridley device is inconvenient in that it is not readily adaptable to be used in the normal infant environment without the need to install the special pad and, of course, to insure that the hook and loop fastening devices are not covered up by other coverings within the infant enclosure or environment.

It would, therefore be advantageous for a positioning device that can surround the infant if desired, be usable in the normal infant environment, be easily configured to the particular infant and, of course, be completely safe to the infant when left in that environment where the infant is contained.

SUMMARY OF THE INVENTION

Now, therefore, in accordance with the present invention, an elongated infant positioning device is provided that overcomes the disadvantages of the prior art devices and makeshift arrangements. In the present device, a soft fleece or exterior sleeve is used that contains plastic pellets. The sleeve is comprised of a soft material that is fully washable and is safe to lay against the skin of the infant and preferable is a synthetic polyester material. That material does not adversely affect the skin of the infant and is non-absorbent, that is, it does not retain water well. Therefore, fluids from spills and leaks are not trapped next to the skin of the infant. Fluids can pass through the device and, for example, the device having the preferred material can be machine washed and will be almost dry upon being removed from the washer. The device can then be simply air dried within a very short time following total submersion during the washing operation.

Contained within the fleece is a plurality of individual pellets comprised of a material that is inert to medicines, fluids or other materials that are likely to be inadvertently spilled within the infant apparatus. The pellets themselves are composed of a material that has sufficient weight so as to allow the elongated positioning device to surround the infant and maintain itself in the particular desired configuration.

The device is elongated and flexible to enable the user to position the device as desired against the infant and will easily adapt itself to conform to the individual contour of the infant and is of a one piece construction. The adaptability of the elongated device enables the user to easily shape the device around the infant and can allow the user to place the infant in the prone, supine or sidelying positions in a positive, stable manner. In addition, by changing the dimensions of the present positioning device, it can be easily customized for use with premature infants as well for full term infants and without changing the overall adaptability of the device.

In the preferred embodiment, the pellets are a high density polyethylene material that are contained within the sleeve sufficiently to optimize the flexibility of the device, that is, the sleeve is filled to about 75% capacity of the sleeve such that the device can be contoured easily but still have sufficient firmness to provide the necessary support for the infant.

Thus, all of the materials used with the present positioning device are environmentally friendly and do not raise a risk of harm to the infant even if brought in contact with other substances used in the care of the infant and all materials are completely washable without disassembly or reassembly and thus is convenient to maintain and use on differing infants.

These and other characteristics of the present invention will become apparent through reference to the following detailed description of the preferred embodiment and accompanying drawings.

DETAILED DESCRIPTION OF THE INVENTION

Figure 1:
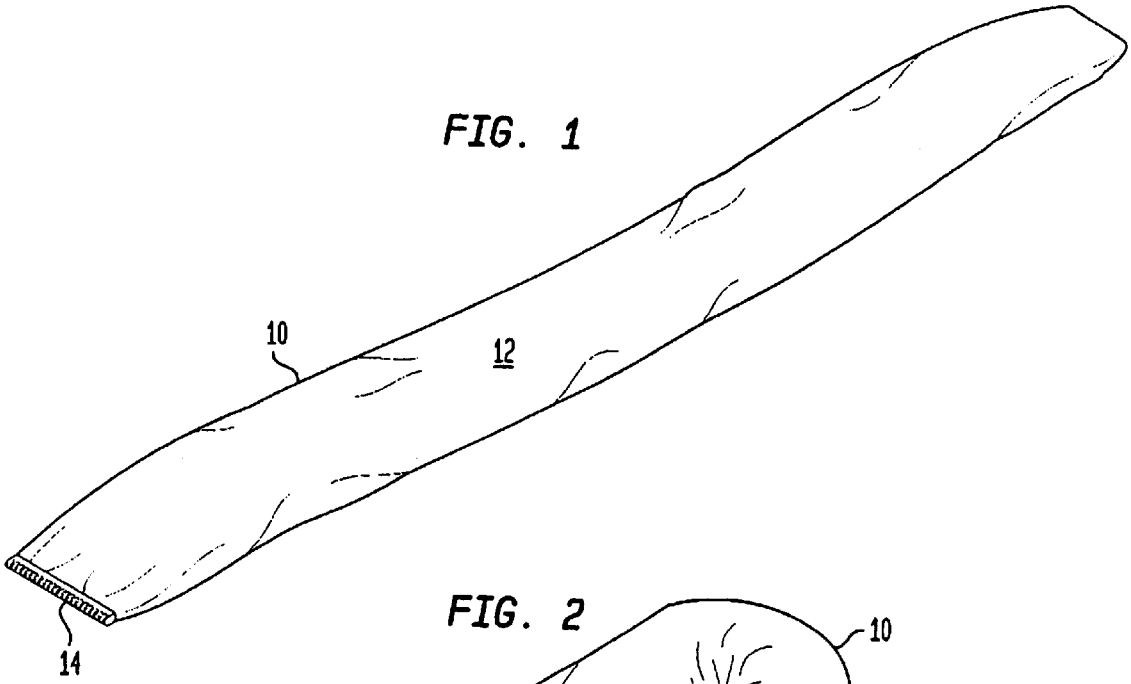
FIG. 1 is a perspective view of the infant positioning device of the present invention in its fully elongated configuration.

Referring now to FIG. 1, there is shown a perspective view of an infant positioning device 10 constructed in accordance with the present invention. As can be seen, the device 10 is generally elongated and is comprised of a covering sleeve 12 made of a material that is compatible with a lengthy direct contact with the sensitive skin of an infant. In general, the sleeve 12 is of a soft, spill-resistant material and is preferably of a synthetic material such as 100% polyester and even more preferably, with a polyester material of 380 gms/meter, 100% spun polyester fleece fabric. The preferred material is selected for its outer feel so as to not abrade the skin of the infant and also so as to be non-absorbent of liquids so that the device does not retain water well such that fluids spilled near the infant are not trapped and retained next to the infant's skin. In addition, of course, the material preferably is washable so that the entire device 10 can easily be washed between use on infants.

Figure 2:
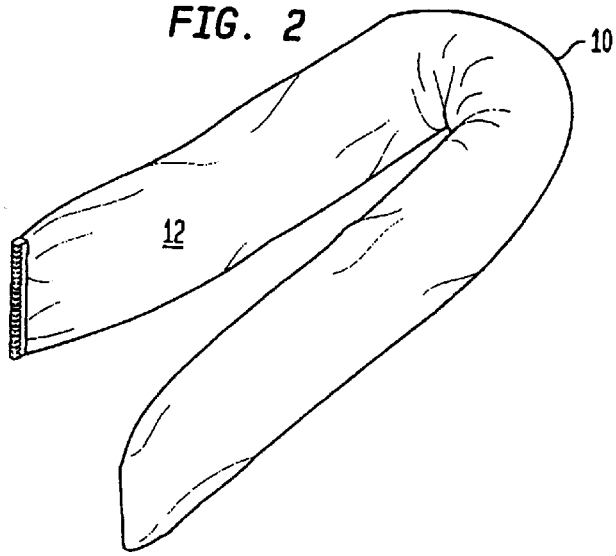
FIG. 2 is a perspective view of the infant positioning device of FIG. 1 in a curved configuration as would be used in partially encircling an infant.

The lateral cross section of the device 10 is generally oval shaped so as to nestle against the infant and the length is such that the device 10 can be, as desired, curled around the infant as shown in the configuration of FIG. 2 to retain the infant in the desired secure position. Suitable stitching 14 secures at least one end of the elongated device 10 after being filled as will later be explained.

Figure 3:
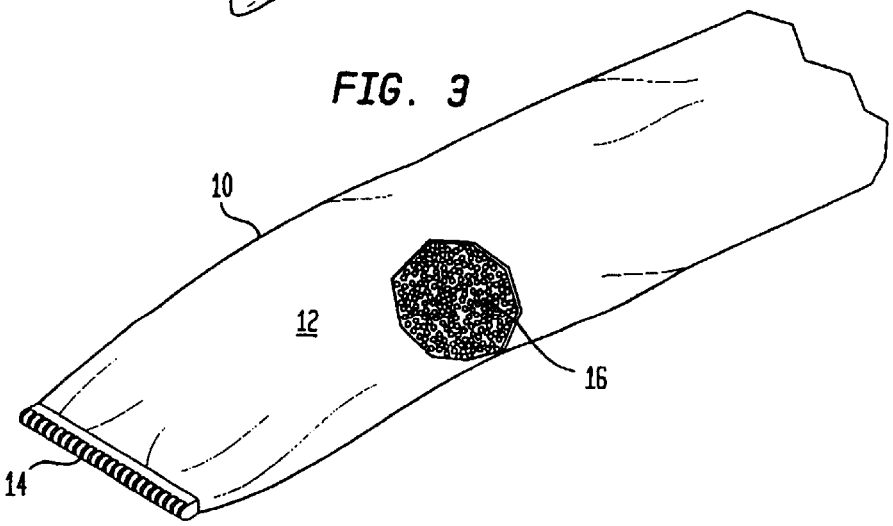
FIG. 3 is an enlarged perspective end view, partially cut away, showing one of the ends of the present infant positioning device.

Turning now to FIG. 3, there is shown an enlarged perspective view, partially cut away, of one end of an infant positioning device 10 of the present invention. In the cut away section, there can be seen a plurality of pellets 16 that comprise the fill for the sleeve 12. The material of the pellets 16 can comprise a polymeric plastic composition and in the preferred embodiment, the composition is of a high density polyethylene (HDPE). Also in the preferred embodiment, the pellets 16 may be spherical having a diameter of about one eighth to one quarter of an inch. Other shapes can certainly be used, however, the size should be comparable for those other shapes.

With that preferred material and shape of the pellets 16, there is sufficient weight to provide a stable support for the infant to contain the infant in the optimal position as desired. In addition, the HDPE material is inert to most liquids as well as to other materials that could conceivable be spilled within the environment of the infant, including medicines that are used with the infants. As such, the material, HDPE, can be used within the infant apparatus and in close proximity to the infant without the difficulty of a toxic atmosphere being present or being developed by contact with other materials.

Of importance to the present invention is the amount of pellets 16 that are introduced into the interior of the sleeve 12, that is, the fill density and which is defined as the volume of pellets that are contained with the internal volume of the sleeve. Since the device 10 must be reasonable pliable so as to be conformed to various positions, including partially surrounding the infant, the fill density of the pellets 16 cannot be so full that compliance and flexibility is not attainable, that is, if the sleeve 12 is 100% filled with the pellets 16, there would be no pliability of the device 10 and, as such, it use limited. On the other hand, if the pellets 16 are insufficiently filled within the sleeve 12, there would be inadequate stability and bulk to the device 10 to enable it to properly support the infant in the desired position. In the present invention, therefore, it is preferred that the sleeve 12 be filled to about 70 to 80 percent of its volume with pellets, and more preferably with a fill density of about 75 percent.

With that fill density, and the use of high density polyethylene pellets, the infant positioning device can readily be maneuvered by the user to wrap around the infant and yet be sufficiently strong to maintain the infant in the desired position.

It is expressly understood that the claimed invention is not limited to the description of the preferred embodiment but encompasses other modifications and alterations within the scope and spirit of the inventive concept.

I claim:

1. An elongated, flexible positioning device for use in supporting and surrounding an infant in a desired position, said positioning device having a generally oval shaped lateral cross section, said positioning device comprising an elongated sleeve containing a plurality of high density polymer pellets, said elongated, flexible positioning device having a predetermined fill density of pellets per volume within said sleeve to allow said elongated flexible positioning device to be bent into a position to generally encircle the infant.

2. A positioning device as defined in claim 1 wherein the composition of said pellets is high density polyethylene.

3. A positioning device as defined in claim 1 wherein said elongated sleeve is comprised of a polyester fleece fabric.

4. A positioning device as defined in claim 1 wherein said fill density of said pellets comprises about 70 to 80 percent of pellets filling the sleeve.

5. A positioning device as defined in claim 4 wherein said fill density is about 75 percent.

6. A positioning device as defined in claim 1 wherein said pellets comprise spherical pellets having an outer diameter of between about one eighth and one quarter inch.

* * * * *